US006360941B1

(12) United States Patent
Larsson

(10) Patent No.: US 6,360,941 B1
(45) Date of Patent: Mar. 26, 2002

(54) PACKAGE

(75) Inventor: Bo Larsson, Varberg (SE)

(73) Assignee: Almondy AB (SE)

( * ) Notice: Subject to any disclaimer, the term of this patent is extended or adjusted under 35 U.S.C. 154(b) by 0 days.

(21) Appl. No.: 09/445,820

(22) PCT Filed: Mar. 24, 1999

(86) PCT No.: PCT/SE99/00459

§ 371 Date: Feb. 29, 2000

§ 102(e) Date: Feb. 29, 2000

(87) PCT Pub. No.: WO99/52780

PCT Pub. Date: Oct. 21, 1999

(30) Foreign Application Priority Data

Apr. 14, 1998 (SE) ..... 9801291

(51) Int. Cl.[7] ..... B65D 5/54; B65D 17/34

(52) U.S. Cl. ..... 229/115; 229/243; 229/244; 229/906

(58) Field of Search ..... 229/115, 240, 229/242, 243, 244, 906; 206/551

(56) References Cited

U.S. PATENT DOCUMENTS

| | | | | | |
|---|---|---|---|---|---|
| 2,367,706 | A | * | 1/1945 | Williamson | 229/240 |
| 3,309,005 | A | * | 3/1967 | Pilger | 229/906 |
| 3,361,332 | A | * | 1/1968 | Mason | 229/240 |
| 4,313,542 | A | * | 2/1982 | Roberts et al. | 229/115 |
| 4,432,489 | A | * | 2/1984 | Cote | 229/115 |
| 4,477,014 | A | | 10/1984 | Brandenburger | |
| 4,911,305 | A | | 3/1990 | Chung et al. | 206/628 |
| 4,951,824 | A | | 8/1990 | Kuchenbecker et al. | 206/625 |
| 5,213,255 | A | | 5/1993 | Cote | 229/115 |
| 5,624,033 | A | * | 4/1997 | Arai et al. | 229/240 |
| 6,098,874 | A | * | 8/2000 | Tokarski | 229/242 |

FOREIGN PATENT DOCUMENTS

| | | |
|---|---|---|
| EP | 0248241 | 12/1987 |

* cited by examiner

*Primary Examiner*—Gary E. Elkins
(74) *Attorney, Agent, or Firm*—Orum & Roth

(57) ABSTRACT

A container (1) for holding products and comprising a lower part (3) including a bottom panel (5) and side walls (8, 9) upstanding therefrom as well as a top part (4) including a lid (10) and side walls (13, 14) depending therefrom. At least one side wall (15) of the lower and top parts (3 and 4 respectively) extending in adjoining overlapping relationship. The lid (10) is prolonged at its edge (18) that is turned towards the common side wall (15) in order to form a projecting lid-opening grip flap (19). The flap, having been doubled, extends back rearwardly to and connects to the common side wall via a tear perforation (23). At a score (11) between the lid (10) of the top part (4) and at least one of its other side walls (13, 14) there is a rear face cut score (24), such that the lid (10), when a pulling force is applied on the lid-opening grip flap (19), may be opened as a result of splitting of the tear perforation and the rear-face cut score.

10 Claims, 2 Drawing Sheets

PACKAGE

TECHNICAL FIELD

The present invention relates to a package generally and more specifically to a trough-like container for holding such products as cakes, pastry, confectionery and the like, which container is made from a single-piece flat blank of a foldable material, preferably paper-board, and which comprises a lower part including a bottom panel and side walls upstanding therefrom along scores, as well as a top part including a lid and side walls depending therefrom along scores, at least one side wall being common to said lower and top parts whereas remaining side walls extend in mutually adjoining overlapping relationship.

BACKGROUND OF THE INVENTION

Containers of the kind outlined above, designed and configured in a variety of different ways, are already known. In order to make it possible to open the lid to allow access to the product inside the container, lengthwise tear-off tapes may provided on those depending side walls of the top part that are joined to the lid along the scores, approximately at a level corresponding to half the height dimension of the walls. When the tapes are torn off, the lid can be folded upwards, and when this is done, the side wall parts located between the lid and the torn-off tapes will accompany the lid whereas the side-wall parts below the area of the torn-off tapes still adhere to the upstanding side walls of the lower part. These tear-off tapes may be difficult to grip safely and correctly for rapid and efficient removal, on the one hand because they are comparatively narrow, and on the other because they are located level with the side walls of which they form a part. In addition, this kind of tear-off tapes tend to break before they are torn off completely, which makes it even more difficult to open the lid.

OBJECT OF THE INVENTION

The object of the invention is to provide a container of the kind outlined above, wherein the disadvantages referred to are eliminated owing to the provision of a container lid of which is easy and convenient to open, requiring only a minimum of effort.

SUMMARY OF THE INVENTION

This object is achieved in a manner that is as simple as it is ingenious and resides therein that the lid is prolonged at its edge that is turned towards at least one of the associated side walls, in order to form a lid-opening grip flap projecting beyond the side wall in question essentially in the plane of the lid, said grip flap being doubled back along its outer edge along a score and extending rearwardly back to said side wall, to which said grip flap is connected by means of a first weakening line, and in that a second weakening line is provided adjacent the score between the lid of the top part and at least one of the other side walls thereof, such that it becomes possible to open the lid, when the grip flap is pulled and as a result thereof the weakening lines split.

BRIEF DESCRIPTION OF THE DRAWINGS

The invention will be described in more detail in the following with reference to the accompanying drawings, wherein.

DESCRIPTION OF A PREFERRED EMBODIMENT

Figure 1:
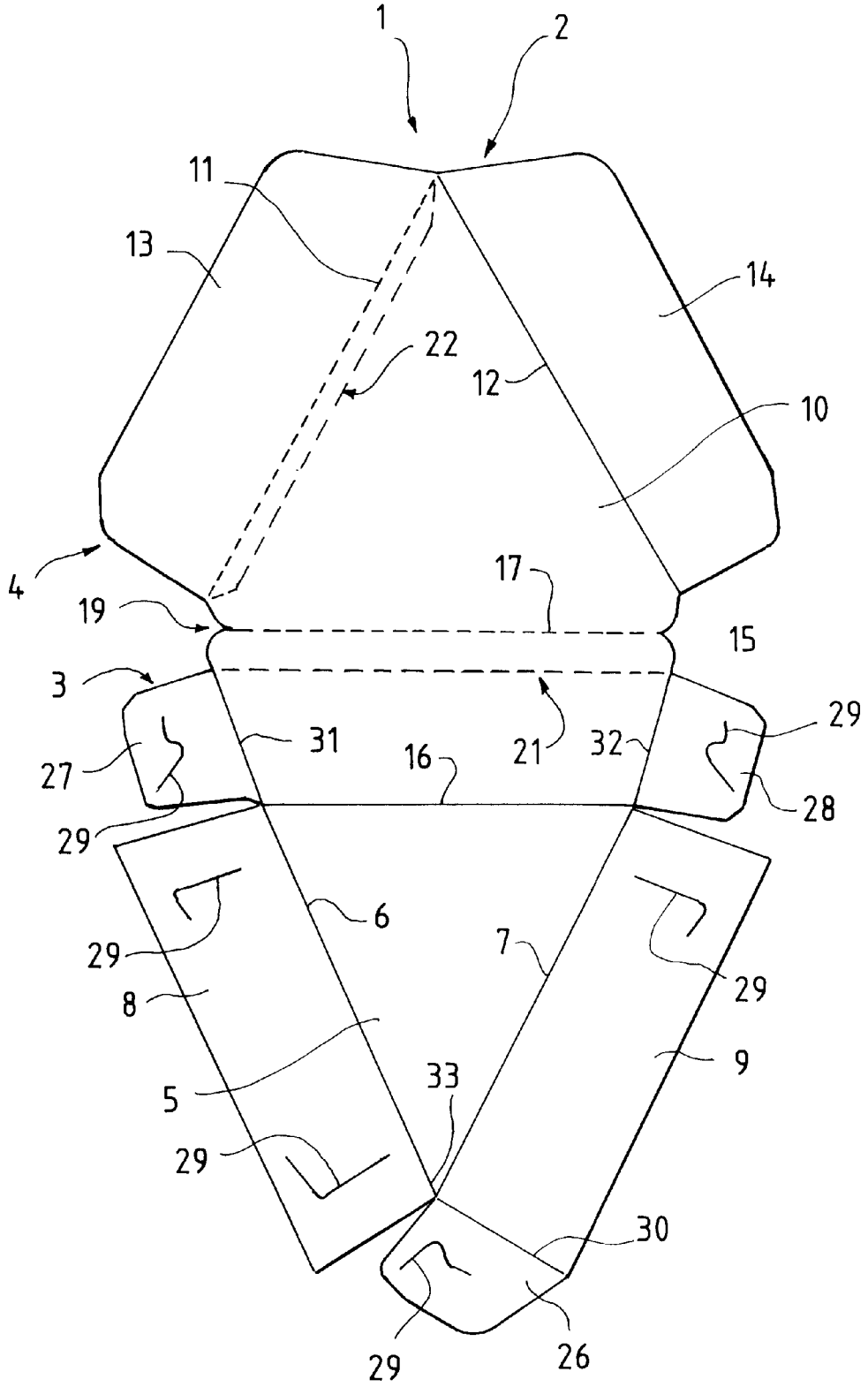
FIG. 1 is a view from above of a flat blank designed to form a container in accordance with the invention.

The container designated generally by numeral 1 in the drawings has for its purpose to serve as a protective enclosure during transport of various products contained therein, such as pieces of confectionery, pastry, cakes, pizza and pies and the like, which may have an outline configuration identical to that of the container. In accordance with the shown embodiment the container 1 has a generally triangular shape but this shape is but one of several possible ones. Preferably, the container 1 is made from a flat blank 2, which may be made as one single integral piece from a foldable material, preferably paper-board, or still more preferably, from folding boxboard.

The container 1 is composed from two main parts, viz. A lower part 3 and a top part 4. The lower part 3 has a flat bottom panel 5 and two flat side walls 8 and 9 upstanding essentially perpendicularly from said bottom panel along straight scores 6 and 7. In a similar manner, the top part 4 comprises a flat lid 10 and two side walls 13 and 14 depending essentially perpendicularly from said lid along straight scores 11 and 12. The side walls 8, 9 are arranged in adjoining overlapping relationship as will be described in more detail in the following. In addition, the top and lower parts 3, 4 have one common, flat side wall 15, which extends essentially perpendicularly to the bottom panel 5 of the lower part 3 and to the lid 10 of the top part 4 and which is connected thereto by means of scores 16 and 17.

The flat lid 10 on the top part 4 is prolonged at that edge which is turned towards at least one of the associated side walls 13, 14, 15, in the case of the shown embodiment edge that is turned towards the common side wall 15, in order to form a lid-opening grip flap 19, which projects essentially in the plane of the lid 10 beyond the side wall 15. This grip flap is folded-over by 180° along the above-mentioned score along its straight outer edge and then extends backwards, to the common side wall 15. The grip flap 19 is connected to the common side wall 15 by a first weakening line 21 to be described in more detail in the following.

In the area of the score 11 or 12, intermediate the lid 10 of the top part 4 and at least one of its other side walls 13 or 14, in the present case the score 11 between the lid 10 and side wall 13, there is provided a second weakening line 22 to be described in more detail in the following. This second weakening line 22, together with the first weakening line 21, makes it possible to open up the lid 10 as a result of the weakening lines splitting as the grip flap 19 is pulled by means of the fingers of one hand.

Both the first and the second weakening lines 21 and 22, respectively, may be configured as a tear perforation or a cut score on the rear face, i.e. the paper-board is perforated-through or is cut on the inner face to a depth corresponding at the most to half the paper-board thickness. In accordance with the shown and described preferred embodiment the first weakening line 21 between the grip flap 19 and the common side wall 15 is a tear perforation 23 whereas the second weakening line 22 between the lid 10 and the associated side wall 13 in question is a cut score cut on the rear face.

Because the tear perforation and the rear-face cut score split open as pulling forces are applied to the grip flap 19, it becomes possible, as mentioned previously, to open the lid 10 for access to the contents of the container 1. If it is desired that the lid 10 be removable in its entirety, a further weakening line in the form of a tear perforation, a rear-face cut score or the like, may be made along the score 12 between the lid 10 and the remaining side wall 14.

The container 1 described in the aforegoing is, as already mentioned, produced through erection of the flat blank 2 by folding edge flaps 26, 27 and 28, located at the front end of one 9 of the side walls of the lower part 3 and at the ends of the common side wall 15, along scores 30, 31 and 32 into abutting relationship with the two side walls 8 and 9 of the lower part, to which walls these flaps are hooked by introduction into conventionally configured, co-operating hook-like slits 29. The common side wall 15 is folded essentially at right angles to the bottom 5 of the lower part 3 upwards along the score 16, whereas the lateral walls 8, 9 of the lower part are folded upwards along the scores 6, 7. Because in the shown embodiment the angle between the scores 7 and 30 exceeds 90° , the side walls 8, 9 will extend at an angle outwards corresponding to the angle between score 16 and scores 31, 32. This arrangement makes it easier to load the products into the container and also improves the stackability feature of erected blanks 2.

Prior to loading a product into the container 1 the top part 4, composed by the prolonged lid 10 and the side walls 13, 14, extends straight upwards in parallel with the common side wall 15. During the very loading operation, the top part 4 is, however, folded rearwards, over more than 90°, along the first weakening line 21.

Figure 2:
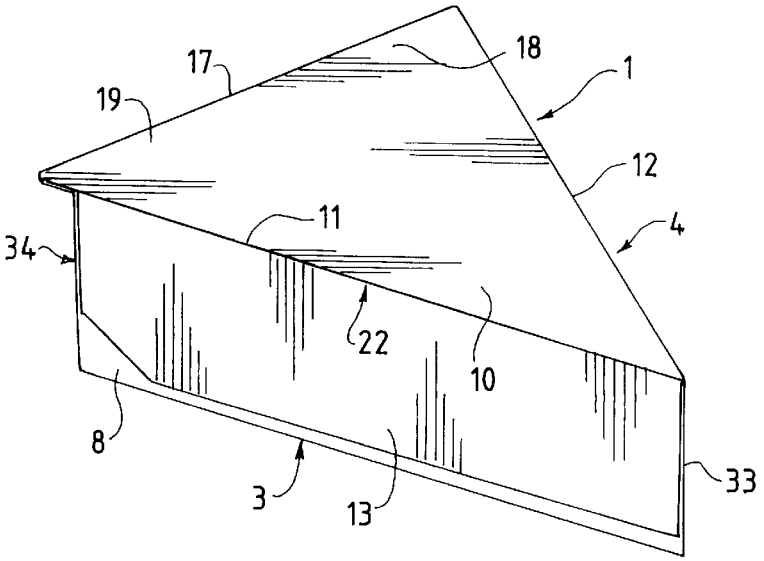
FIG. 2 is a perspective view as seen obliquely from the front of a completely erected container filled with a product.

Following the product-loading operation, the top part 4 is closed by the lid 10 and the side walls 13, 14 being folded back along the score 17. The container is then closed in that the side walls 13, 14 are folded along the scores 11, 12 and adhered to the side walls 8, 9 of the lower part 3, in overlapping relation with said walls. The container 1 is now completed and assumes the appearance shown in FIG. 2.

Figure 3:
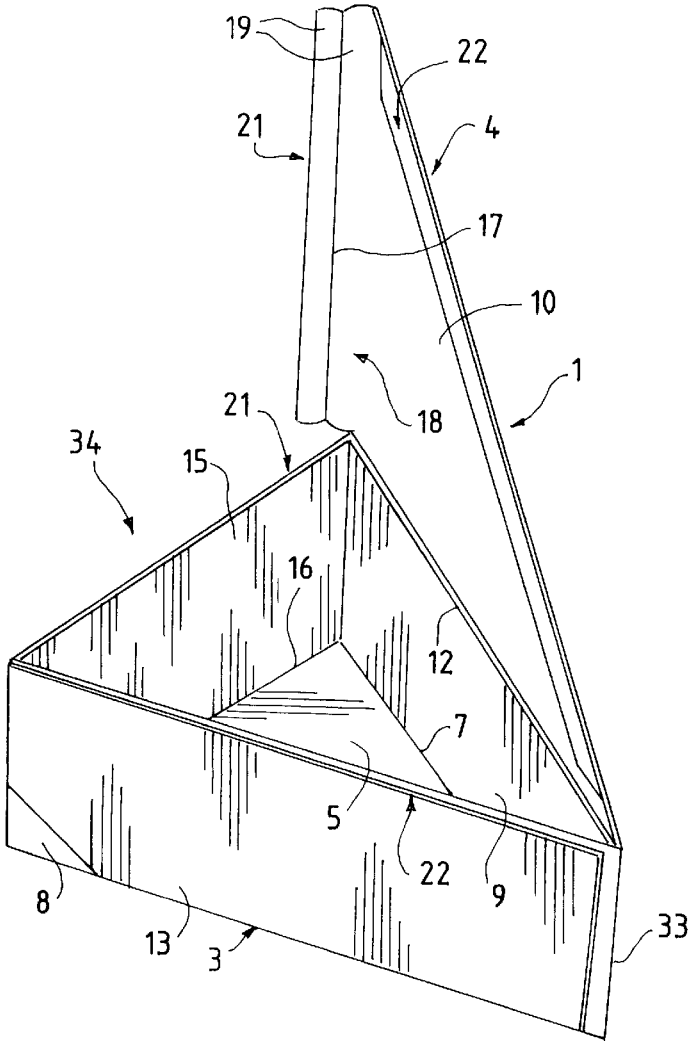
FIG. 3 is a projection corresponding to FIG. 2 and shows the same container with the lid open.

When the product inside the container 1 is to be consumed, the container 1 is opened by application of a pulling force manually on the rearwardly projecting lid-opening grip flap 19. The pulling force causes the paper-board to burst along the weakening lines 21, 22, i.e. in the present case along the tear perforation and the rear-face cut score. The rear-face cut score causes the paper-board to separate in a controlled manner, producing a pleasant-looking opening. The lid 10 connects to the lower part 3 along the score 12 of the side wall 14 on the top part 4, which wall is adhered to the side wall 9 of the lower part, as shown in FIG. 3.

If desired, also the score 12 may, as already mentioned, be formed as a weakening line in the form of a tear perforation or a rear-face cut score, allowing the entire lid 10 to be torn away or removed.

The preferred embodiment of the container 1, which is shown in the drawings and described above, is, as already mentioned, triangular with the overlapping side walls 8, 13 and 9, 14 of the lower and top parts 3 and 4, respectively, converging in the direction towards a front peak 33 whereas their common side wall 15 forms a rear panel 34, with the lid-opening grip flap 19 projecting rearwardly from the rear panel 34. As also mentioned previously, this design of the container 1 is but one of several possible ones.

Consequently, the invention must not be considered limited to the embodiment described and illustrated herein but may be modified in a variety of ways within the scope of protection as defined in the appended claims.

What is claimed is:

1. A container for holding products, comprising:

a container (1) made from a single-piece flat blank (2) of a foldable material, with a lower part (3) including a bottom panel (5) and side walls (8, 9) upstanding therefrom along scores (11, 12), a top part (4) including a lid (10) and side walls (13, 14) depending therefrom along scores, a connecting wall common to said lower and said top parts (3 and 4, respectively) the side walls (8, 9, 13, 14) extend in mutually adjoining overlapping relationship; wherein the lid (10) is prolonged at an edge of the connecting wall in order to form a lid-opening grip flap (19) projecting beyond the connecting wall substantially in the plane of the lid, said grip flap (19) being doubled back along an outer edge along a score (17) and extending rearwardly back to said connecting wall, to which said grip flap (19) is connected by means of a first weakening line (21), and in that a second weakening line (22) is provided at the score (11) between the lid (10) of the top part (4) and at least one of the side walls (13, 14) thereof, such that it is possible to open the lid (10), when the grip flap (19) is pulled, and as a result thereof the weakening lines (21, 22) split.

2. A container as claimed in claim 1, wherein the lid (10) is prolonged at its edge (18) that is turned towards the common side wall (15) to form said lid-opening grip flap (19) projecting beyond said common side wall (15), said grip flap (19), having been doubled, extending rearwardly back to and being connected to said common side wall via said first weakening line (21).

3. A container as claimed in claim 1 wherein at least one of the weakening lines (21 or 22) is either a tear perforation (23) or a rear-face cut score (24).

4. A container as claimed in claim 1, wherein the first weakening line (21) between the lid-opening grip flap (19) and the connecting wall (15) is a tear perforation (23).

5. A container as claimed in claim 1, wherein the second weakening line (22) between the lid (10) of the upper part (4) and at least one the side walls (13, 14) is a rear-face cut score (24).

6. A container as claimed in claim 1, wherein at least one additional weakening line (15) is provided adjacent the score (12) between the lid (10) of the upper part (4) and the other side walls (14), whereby the entire lid (10) becomes removable.

7. A container as claimed in claim 6, wherein the additional score (15) is one of a tear perforation and a rear-face cut score.

8. A container as claimed in claim 1, wherein the upstanding side walls (8, 9) of the lower part (3) are interconnected by edge flaps (26, 27, 28) and slits (29) co-operating therewith.

9. A container as claimed in claim 1, wherein the overlapping side walls (8, 13 and 9, 14, respectively) of the top and lower parts (3 and 4, respectively) are adhered to one another.

10. A container as claimed in claim 1, wherein said container is triangular, the overlapping side walls (8, 13 and 9, 14, respectively) of said top and lower parts (3 and 4, respectively) converging towards a front peak (33) while their common side wall (15) forms a rear panel (34) containing the lid-opening grip flap (19) projecting rearwardly from said rear panel.

* * * * *